US005540873A

United States Patent [19]

Knapp

[11] Patent Number: 5,540,873

[45] Date of Patent: Jul. 30, 1996

[54] PROCESS OF MAKING PLASTIC BRISTLES

[75] Inventor: Arthur Knapp, Wald-Michelbach, Germany

[73] Assignee: Pedex & Co. GmbH, Wald-Michelbach, Germany

[21] Appl. No.: 301,004

[22] Filed: Sep. 6, 1994

[30] Foreign Application Priority Data

Sep. 4, 1993 [DE] Germany ..... 43 29 895.8

[51] Int. Cl.[6] ..... B05D 1/18; B29C 47/02; B29C 70/70

[52] U.S. Cl. ..... 264/136; 264/137; 264/171.13; 264/177.13; 427/434.6

[58] Field of Search ..... 264/136, 137, 264/174, 176.1, 177.13; 427/434.6

[56] References Cited

U.S. PATENT DOCUMENTS 3,577,839 5/1971 Charvat et al. .
3,871,048 3/1975 Leigh ..... 264/174 X
4,093,693 6/1978 Lemelson ..... 264/174 X

FOREIGN PATENT DOCUMENTS 513798 11/1992 European Pat. Off. .

OTHER PUBLICATIONS

Abstract of Japan 1–262,806 (Published Oct. 19, 1989).
Abstract of Japan 4–367,613 (Published Dec. 18, 1992).
Abstract of Japan 6–55,460 (Published Mar. 1, 1994).

*Primary Examiner*—Leo B. Tentoni
*Attorney, Agent, or Firm*—Antonelli, Terry, Stout & Kraus

[57] ABSTRACT

Plastic bristles made of a thermoplastic or thermosetting plastic material are proposed, into which reinforcing fibers in the form of at least one endless fiber bundle are embedded to increase the bending strength, abrasion resistance, and breaking strength. The fibers preferably are composed of glass fibers, aramid fibers, carbon fibers, or high-strength polyethylene fibers. The plastic material of the bristles can be extruded together with the reinforcing fibers, but it is also possible to manufacture the plastic bristles in a pultrusion bed.

16 Claims, 1 Drawing Sheet

PROCESS OF MAKING PLASTIC BRISTLES

BACKGROUND OF THE INVENTION

1. Field of the Invention

The invention relates to plastic bristles composed of a thermoplastic or thermosetting plastic material as well as a method for their manufacture.

2. Description of the Prior Art

In conjunction with the industrial use of brushes, especially for sweeping, cleaning, grinding, or polishing, so-called technical bristles are usually employed that have brush holders fitted with wire bristles. These wire bristles are disadvantageous in some ways since they damage certain surfaces, for example when sweeping or cleaning, break off when highly stressed, make a loud noise, and are very heavy. An example of this kind is street sweepers with rotating wire brushes that scratch the surfaces of curbstones and roads and/or damage seals, which are then more prone to attack from surface water, frost, oils, etc., become unattractive sooner, and are subject to greater wear.

Because the manufacture of brushes with wire bristles as well as the manufacture of the suspension for the brush bodies, due to the high weight of the wire bristles, is relatively tedious and expensive, attempts have been made to use plastic bristles since these can be manufactured and processed quickly and economically.

It has been found however that plastic bristles, regardless of what plastic material they are made of, do not have sufficient abrasion and breaking resistance to ensure sufficiently long service life in industrial applications.

In addition, especially at the longer bristle lengths used for this application, it is not possible to achieve sufficient bending stiffness with pure plastics.

SUMMARY OF THE INVENTION

The goal of the invention is to provide plastic bristles with increased stiffness and hardness, as well as a method by which the plastic bristles can be manufactured in simple fashion.

This goal is achieved according to the invention with regard to plastic bristles by the fact that reinforcing fibers in the form of at least one endless fiber bundle are embedded in the plastic material. The reinforcing fibers, which are preferably made of glass fibers, aramid fibers, carbon fibers, or high-strength polyethylene fibers, produce a significant increase in bending stiffness, abrasion resistance, and breakage resistance of the plastic bristles, so that an outstanding cleaning, grinding, and polishing effect can be achieved over a long service life.

A fiber bundle composed of a plurality of individual filaments, after its preliminary manufacture, is saturated and surrounded with the plastic material (matrix) which can be either a thermoplastic or a thermosetting plastic, in such manner that it is completely embedded therein. Then the bristle strand thus produced can be shaded into a round, rectangular star-shaped or other desired cross-sectional form by molding.

The plastic bristles with the endless reinforcing fiber bundles incorporated therein can be manufactured by pultrusion or extrusion. In this method, the reinforcing fiber bundle is guided through a special extrusion tool and saturated and surrounded therein with a plastic melt supplied through an extruder, preferably a thermoplastic. Alternatively it is also possible to pass the reinforcing fiber bundle through a bath of a liquid plastic material, preferably a thermosetting plastic, so that it becomes impregnated. Then the bristle strand is shaped in the manner described above and calibrated, cured, and cooled.

In addition, reinforcing fibers in the form of short fibers with a length in the range from about 0.2 to 0.4 mm or in the range from about 5 to 15 mm can be embedded in the plastic material. In cooperation with short or long fibers, a thermoplastic plastic can preferably be used that is extruded together with the reinforcing fibers. The short reinforcing fibers can then either be incorporated previously into the plastic granulate to be melted in the extrusion process, or provision is preferably made for adding the reinforcing fibers as short fibers during the extrusion process directly into the melt of the thermoplastic plastic.

While the short fibers in the plastic material of the plastic bristles are arranged without a given pattern, but statistically uniformly distributed, the reinforcing fiber bundle can be arranged in a special way. When a single reinforcing fiber bundle is used, the latter advantageously runs in the central axis of the plastic bristle. When a plurality of reinforcing fiber bundles are used in the plastic bristle, the latter can be distributed around the central axis, with a reinforcing fiber bundle possibly located in the central axis. The mechanical strengths and rigidities of the plastic bristles can vary depending on the number of bundles and their arrangement.

BRIEF DESCRIPTION OF THE DRAWINGS

Further details and features of the invention will be evident from the following description of several embodiments with reference to the drawing.

DESCRIPTION OF THE PREFERRED EMBODIMENTS

Figure 1:
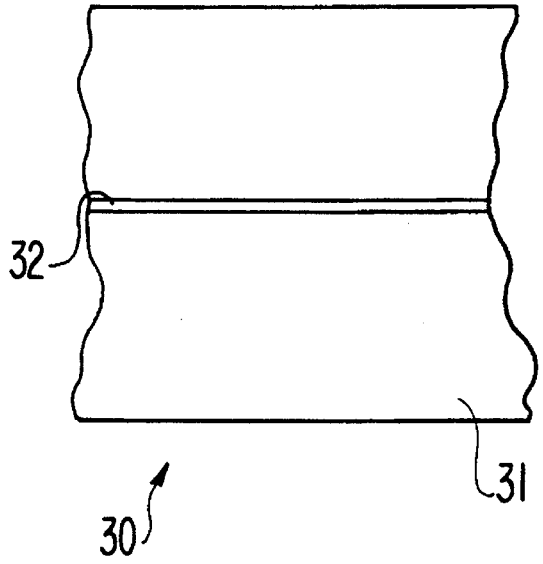
FIG. 1 is a section through a plastic bristle with a reinforcing fiber bundle.
Figure 2:
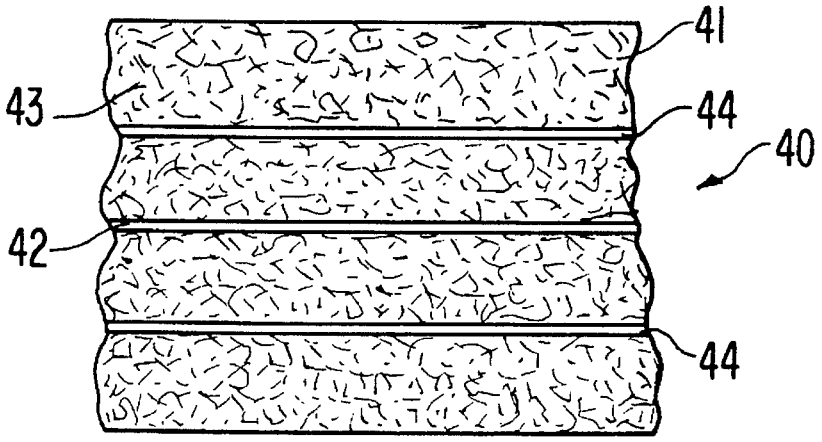
FIG. 2 is a section of a plastic bristle with reinforcing fiber bundles and additional short fibers.

The section of a plastic bristle 30 shown in FIG. 1 has a reinforcing fiber bundle 32 consisting of a plurality of individual filaments and running essentially along the lengthwise axis of plastic bristle 30. Reinforcing fiber bundle 32 is completely embedded in a plastic material 31. Instead of only one reinforcing fiber bundle, several bundles can be provided in the plastic bristle, as shown in FIG. 2. In this embodiment, three fiber bundles are provided of which one fiber bundle 42 runs essentially along the lengthwise axis of plastic bristle 40 while the other two fiber bundles 44 are aligned parallel thereto. All reinforcing fiber bundles 42 and 44 are completely embedded in plastic material 41, with short fibers 43 also being provided therein.

In all of the embodiments mentioned, the fibers or fiber bundles preferably consist of glass fibers, aramid fibers, carbon fibers, or high-strength polyethylene fibers.

I claim:

1. A method for manufacturing plastic bristles comprising:

providing at least one fiber bundle composed of a plurality of individual fibers with the fibers providing reinforcement for the plastic bristles and having bending stiffness, abrasion resistance and breakage resistance to provide brushing with the plastic bristles in industrial applications;

saturating and surrounding the at least one fiber bundle with liquid plastic material and thereafter hardening the liquid plastic material to completely embed the at least one fiber bundle therein; and shaping the at least one fiber bundle to form the plastic bristles having a desired cross-sectional shape.

2. The method in accordance with claim 1 further comprising:

guiding the at least one fiber bundle through an extrusion tool followed by saturating and surrounding the at least one fiber bundle with the liquid plastic in an extruder.

3. A process in accordance with claim 1 wherein:

the liquid plastic is a thermoplastic material.

4. A process in accordance with claim 2 wherein:

the liquid plastic is a thermoplastic material.

5. A method in accordance with claim 1 wherein:

reinforcing fibers are uniformly distributed into the liquid plastic material prior to the saturating and surrounding of fiber bundle with the liquid plastic material.

6. A method in accordance with claim 1 wherein:

reinforcing fibers are uniformly distributed within a liquid thermoplastic material during an extrusion of the fiber bundle.

7. A method in accordance with claim 2 wherein:

reinforcing fibers are uniformly distributed into the liquid plastic material prior to the saturating and surrounding of fiber bundle with the liquid plastic material.

8. A method in accordance with claim 3 wherein:

reinforcing fibers are uniformly distributed within a liquid thermoplastic material during an extrusion of the fiber bundle.

9. A method in accordance with claim 5 wherein:

the fibers range in length from 0.2 to 0.4 mm.

10. A method in accordance with claim 5 wherein:

the fibers range in length from 5 to 15 mm.

11. A method in accordance with claim 6 wherein:

the fibers range in length from 0.2 to 0.4 mm.

12. A method in accordance with claim 6 wherein:

the fibers range in length from 5 to 15 mm.

13. A method in accordance with claim 7 wherein:

the fibers range in length from 0.2 to 0.4 mm.

14. A method in accordance with claim 7 wherein:

the fibers range in length from 5 to 15 mm.

15. A method in accordance with claim 8 wherein:

the fibers range in length from 0.2 to 0.4 mm.

16. A method in accordance with claim 8 wherein:

the fibers range in length from 5 to 15 mm.

* * * * *

UNITED STATES PATENT AND TRADEMARK OFFICE

CERTIFICATE OF CORRECTION

PATENT NO. : 5,540,873

DATED : July 30, 1996

INVENTOR(S) : Arthur KNAPP and Stephan WIST

It is certified that error appears in the above-identified patent and that said Letters Patent is hereby corrected as shown below:

On the cover page, item [75] should read:

--Inventors: Arthur Knapp, Wald-Michelbach, Germany and Stephan Wist, Grasellenbach, Germany--.

Signed and Sealed this

Eleventh Day of February, 1997

Bruce Lehman

*Attest:*

BRUCE LEHMAN

*Attesting Officer*

*Commissioner of Patents and Trademarks*